US007707997B2

(12) United States Patent
Yoon

(10) Patent No.: US 7,707,997 B2
(45) Date of Patent: May 4, 2010

(54) COOLING APPARATUS OF EXHAUST GAS RECIRCULATION SYSTEM AND METHOD USING THE SAME

(75) Inventor: Sung Il Yoon, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 35 days.

(21) Appl. No.: 11/944,904

(22) Filed: Nov. 26, 2007

(65) Prior Publication Data

US 2008/0302094 A1 Dec. 11, 2008

(30) Foreign Application Priority Data

Jun. 5, 2007 (KR) ..... 10-2007-0055031

(51) Int. Cl.
*F02M 25/07* (2006.01)
*F02M 25/00* (2006.01)

(52) U.S. Cl. ..... 123/568.12

(58) Field of Classification Search ..... 123/568.12, 123/568.11, 41.31; 165/43, 138; 60/298
See application file for complete search history.

(56) References Cited

U.S. PATENT DOCUMENTS

| | | | | |
|---|---|---|---|---|
| 5,582,415 | A * | 12/1996 | Yoshida et al. | 277/592 |
| 7,287,522 | B2 * | 10/2007 | Dupree et al. | 123/568.12 |
| 7,451,749 | B2 * | 11/2008 | Kardos | 123/568.12 |
| 2006/0278377 | A1 * | 12/2006 | Martins et al. | 165/140 |
| 2007/0144500 | A1 * | 6/2007 | Dupree et al. | 123/568.12 |
| 2008/0120972 | A1 * | 5/2008 | Yoon | 60/321 |

* cited by examiner

*Primary Examiner*—Mahmoud Gimie
(74) *Attorney, Agent, or Firm*—Morgan, Lewis Bockius LLP

(57) ABSTRACT

A cooling apparatus of an exhaust gas recirculation system includes a first cooling portion, made of a first material, that receives recirculation exhaust gas; and a second cooling portion, made of a second, different material, that receives the recirculation exhaust gas from the first cooling portion and exhausts the recirculation exhaust gas out of the apparatus. A cooling method of an exhaust gas recirculation system includes receiving a recirculation exhaust gas in a first cooling portion made of a first material; cooling the recirculation exhaust gas in the first coolant portion; receiving the recirculation exhaust gas in a second cooling portion made of a second, different material; and cooling the recirculation exhaust gas in the second coolant portion.

11 Claims, 3 Drawing Sheets

COOLING APPARATUS OF EXHAUST GAS RECIRCULATION SYSTEM AND METHOD USING THE SAME

CROSS-REFERENCE TO RELATED APPLICATION

This application claims priority to, and the benefit of, Korean Patent Application No. 10-2007-0055031, filed in the Korean Intellectual Property Office on Jun. 5, 2007, the entire contents of which are incorporated herein by reference.

BACKGROUND OF THE INVENTION (a) Field of the Invention

The present invention relates to a cooling apparatus and method of an exhaust gas recirculation system.

(b) Description of the Related Art

Nitrogen oxides (NOx) are regulated pollutants. Exhaust gas recirculation (EGR) systems have recently been provided to address this. Generally, NOx is most prevalent when the air-fuel ratio is high. An exhaust gas recirculation system mixes some of the exhaust gas to the air-fuel mixture, reducing the amount of oxygen in the air-fuel mixture, and so lessening generation of NOx.

A hot-type EGR system retards ignition, lessens the air-fuel ratio, and lessens the amounts of particulate materials (PM) and hydrocarbons (HC), as well as the amount of NOx, while a cooled-type EGR system prevents combustion by cooling the exhaust gas and the combustion chamber. Recently, the hot EGR system and the cooled EGR system have been used together: the hot EGR system is used at low load and the cooled EGR system is used at high load.

Generally, temperature of exhaust gas is very high, and so a cooling apparatus is provided to the EGR system. The cooling apparatus should be made of a material that is durable at the high temperatures to which it is exposed. A typical material is stainless steel, which is very heavy and costly.

The above information disclosed in this Background section is only for enhancement of understanding of the background of the invention and therefore it may contain information that does not form the prior art that is already known in this country to a person of ordinary skill in the art.

SUMMARY OF THE INVENTION

A cooling apparatus of an exhaust gas recirculation system includes a first cooling portion, made of a first material, that receives recirculation exhaust gas; and a second cooling portion, made of a second, different material, that receives the recirculation exhaust gas from the first cooling portion and exhausts the recirculation exhaust gas out of the apparatus.

The second material may have a heat-resistant temperature that is lower than that of the first material. The second material may be less dense than the first material.

The first material may be stainless steel and the second material may be aluminum.

The recirculation exhaust gas may flow in opposite directions within the first and second cooling portions.

The first cooling portion may have a first coolant passage, and the second cooling portion may have a second coolant passage.

Coolant may flow from the second coolant passage to the first coolant passage.

A gasket may be provided between the first cooling portion and the second cooling portion.

The gasket may be made of material that includes mica.

The gasket may be about 1.5-2.0 mm thick.

The first cooling portion may include a first cooling fin unit, and the second cooling portion may include a second fin unit.

The second cooling fin unit may be made of aluminum.

The second cooling fin unit may be about 2.5 mm thick or thicker.

At least one mounting bracket may be provided for mounting the apparatus to a cylinder head.

An elastic member may be provided between the mounting bracket and the cylinder head.

A cooling method of an exhaust gas recirculation system includes receiving a recirculation exhaust gas in a first cooling portion made of a first material; cooling the recirculation exhaust gas in the first coolant portion; receiving the recirculation exhaust gas in a second cooling portion made of a second, different material; and cooling the recirculation exhaust gas in the second coolant portion.

DESCRIPTION OF REFERENCE NUMERALS INDICATING PRIMARY ELEMENTS IN THE DRAWINGS

| | |
|---|---|
| 100: | first cooling portion |
| 110: | first coolant passage |
| 120: | first cooling un unit |
| 130: | coolant outlet |
| 200: | second cooling portion |
| 210: | second coolant passage |
| 220: | second cooling fin unit |
| 230: | coolant inlet |
| 300: | gasket |
| 400: | mounting bracket |
| 410: | elastic member |
| 500: | cylinder head |

DETAILED DESCRIPTION OF PREFERRED EMBODIMENTS

An exemplary embodiment of the present invention will hereinafter be described in detail with reference to the accompanying drawings.

Figure 1:
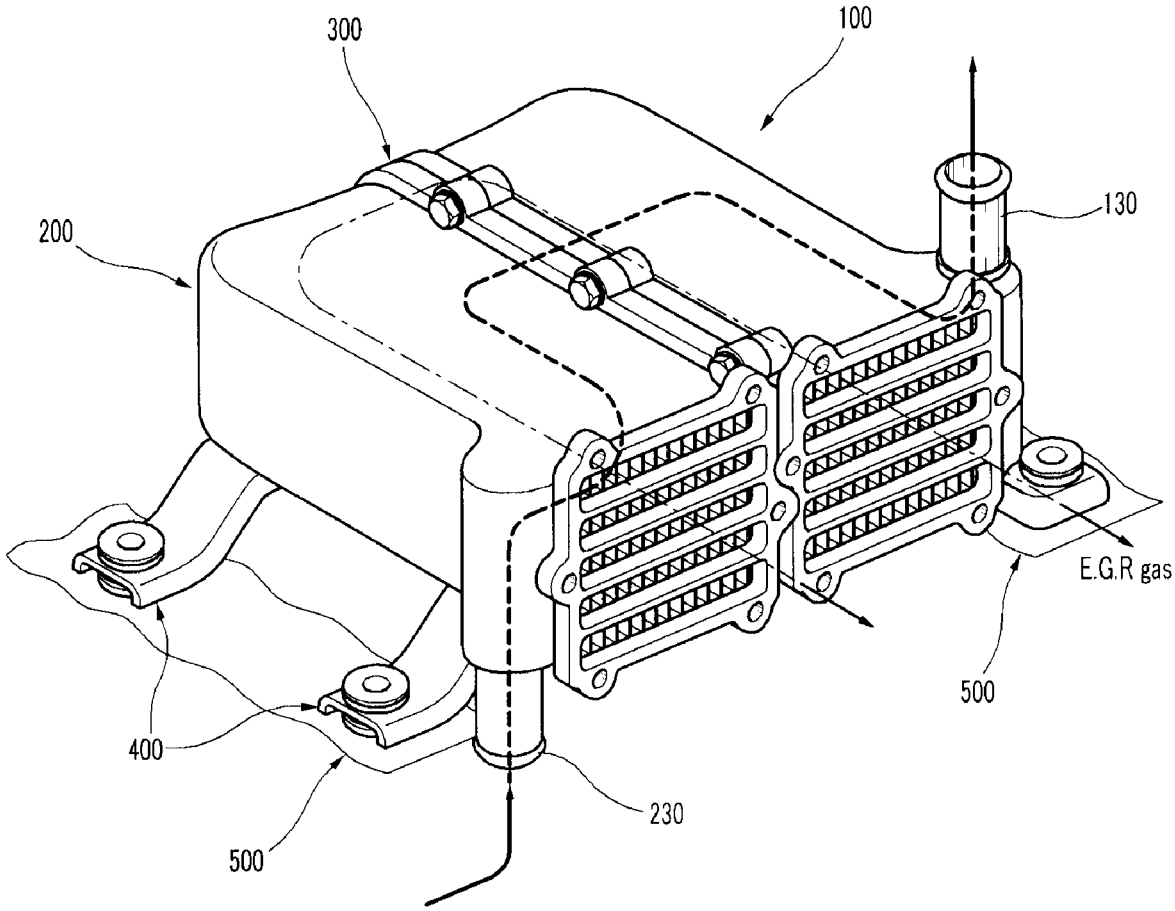
FIG. 1 is a perspective view of a cooling apparatus of an exhaust gas recirculation system according to an exemplary embodiment of the present invention, with a cylinder head shown schematically.

As shown FIG. 1, a cooling apparatus of an exhaust gas recirculation system according to an exemplary embodiment of the present invention includes a first cooling portion 100 that is made of a first material. The first cooling portion 100 receives recirculation exhaust gas at the bottom right of FIG. 1. The apparatus also includes a second cooling portion 200 that is made of a second material and exhausts the recirculation exhaust gas received from the first cooling portion 100.

The first cooling portion 100 and the second cooling portion 200 are manufactured independently from different materials, and are then connected to each other.

The second material may have a lower heat-resistant temperature, and be less dense, than the first material.

Recirculation exhaust gas is typically about 500-600° C., and thus, thermal insulation of the cooling apparatus must be excellent. In addition, because the cooling apparatus is cooled by engine coolant, resistance to corrosion must be excellent. As mentioned in the background section, stainless steel is typically used, but it is heavy and expensive.

The recirculation exhaust gas is cooled from about 500-600° C. to 120-150° C. during its journey through the cooling apparatus.

Therefore, in some embodiments, the first cooling portion is made of stainless steel and the second cooling portion is made of aluminum. The lower temperature EGR gas that has already been cooled in the first cooling portion is further cooling in the second cooling portion. Because of the lower temperature of the EGR gas at this point, aluminum has sufficient thermal characteristics to be used for the second cooling portion. Aluminum is also light and cheap.

As shown in FIG. 1, the flow path of the coolant and recirculation exhaust gas may be U-shaped. This shape provides good cooling efficiency and takes up a small volume.

Thus, the recirculation exhaust gas flows in opposite directions within the first cooling portion 100 and the second cooling portion 200.

Figure 4:
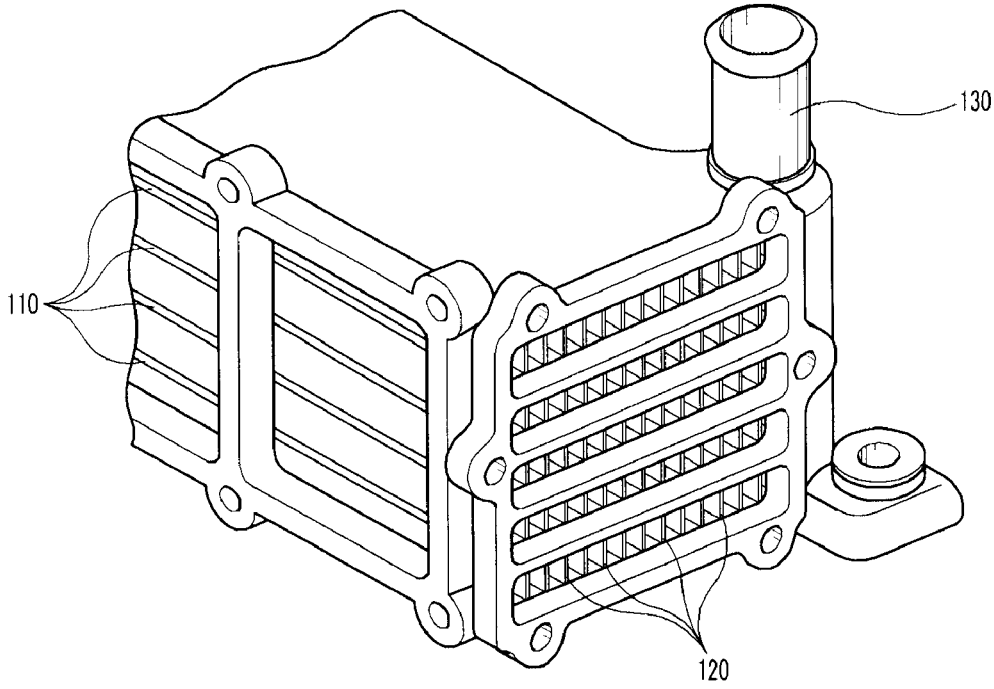
FIG. 4 is a perspective view of a first coolant passage and a first cooling fin of the apparatus of FIG. 1.
Figure 5:
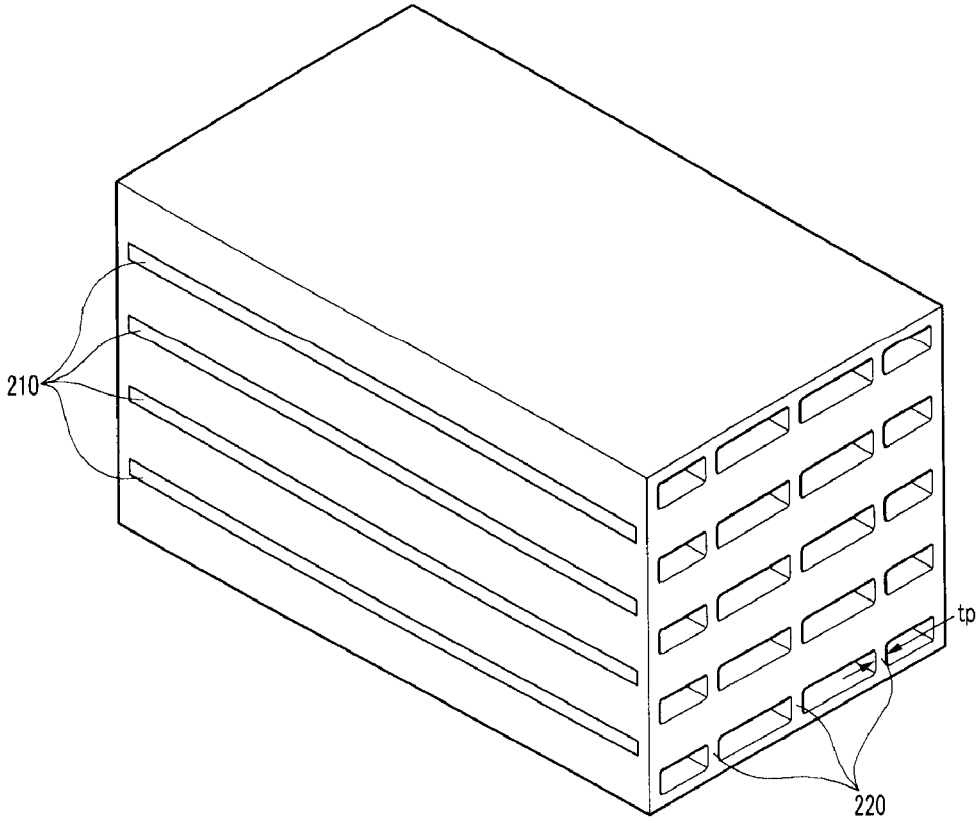
FIG. 5 is a perspective view of a second coolant passage and a second cooling fin unit of the apparatus of FIG. 1.

The first and second cooling portions 100 and 200, as shown in FIG. 4 and FIG. 5, include a first coolant passage 110 and a second coolant passage 210, respectively, through which coolant flows. The coolant flows from the second coolant passage 210 to the first coolant passage 110.

The first cooling portion 100 and the second cooling portion 200 also include a first cooling fin unit 120 and a second cooling fin unit 220, respectively, to cool the recirculation exhaust gas by flowing of the coolant.

To provide enough thermal insulation, the second cooling fin unit 220 has a thickness to >≈2.5 mm.

The second cooling fin unit 220 can be manufactured through a die casting process.

Figure 2:
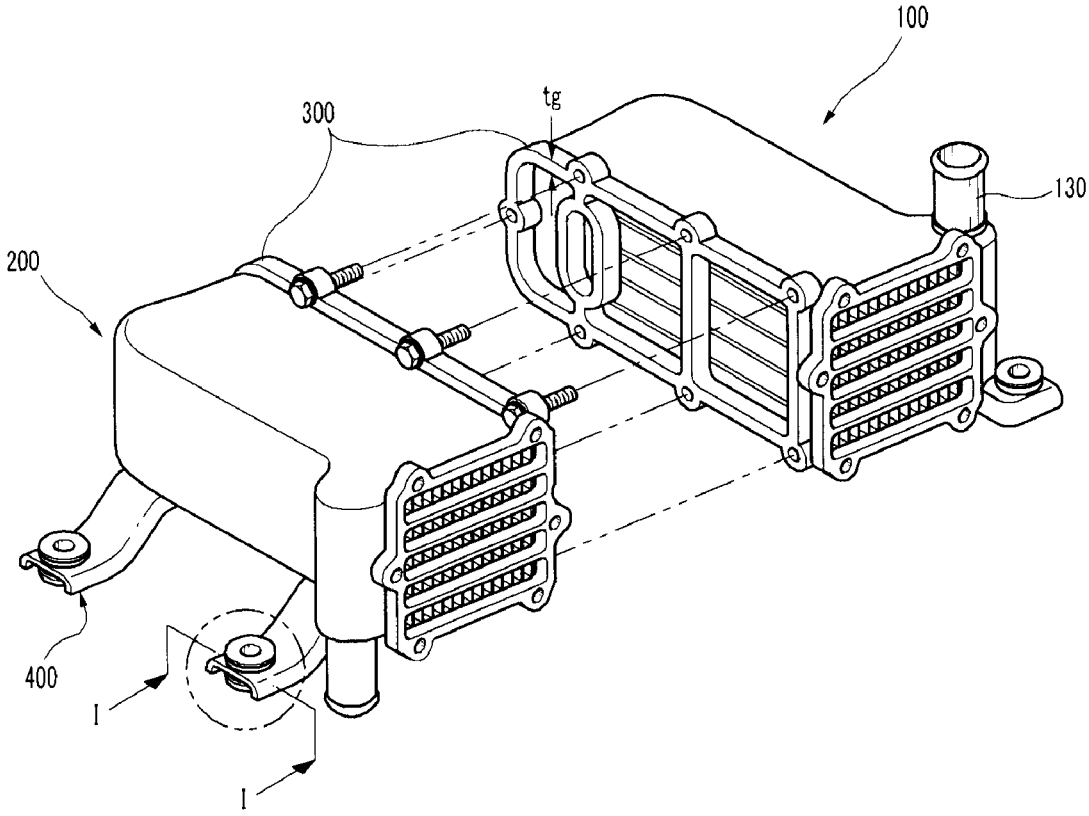
FIG. 2 is an exploded perspective view of the apparatus of FIG. 1.

As shown in FIG. 2, the first and second cooling portions 100 and 200 are made of different materials, and so welding is not easily used to combine the two portions. Thus, a gasket 300 is disposed between the first cooling portion 100 and the second cooling portion 200.

Because the thermal characteristics of the first and second cooling portions 100 and 200 are different, the gasket 300 is made of a durable material including mica. A thickness of the gasket is 1.5-2.0 mm for improving durability due to thermal expansion.

Figure 3:
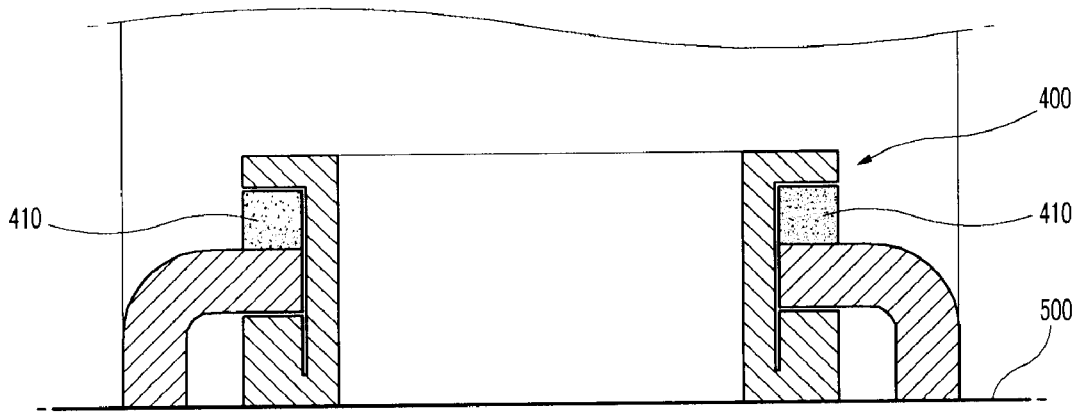
FIG. 3 is a cross-sectional view along the line I-I of FIG. 2.

Mounting brackets 400 are mounted mount the cooling apparatus to a cylinder head 500, as shown in FIG. 3. An elastic member 410 is disposed between each mounting bracket 400 and the cylinder head 500 in order to prevent transference of vibrations.

A cooling method of exhaust gas recirculation according to an exemplary embodiment of the present invention includes a first cooling step in which a recirculation exhaust gas flows into a first cooling portion 100 made of a first material, where the recirculation exhaust gas is cooled by coolant flowing through a first coolant passage 110 in the first cooling portion 100, and a second cooling step in which the recirculation exhaust gas flows from the first cooling portion 100 into a second cooling portion 200 made of a second material that is different from the first material where the recirculation exhaust gas is cooled by coolant flowing through a second coolant passage 210 in the second cooling portion 200.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A cooling apparatus of an exhaust gas recirculation system, comprising:

a first cooling portion, comprising a first material, that receives recirculation exhaust gas; and a second cooling portion, comprising a second, different material, that receives the recirculation exhaust gas from the first cooling portion and exhausts the recirculation exhaust gas out of the apparatus;

wherein the second material comprises a heat-resistant temperature that is lower than a heat-resistant temperature of the first material, and the second material is less dense than the first material;

wherein the recirculation exhaust gas flows in a first direction within the first cooling portion, and in a second, substantially opposite direction within the second cooling portion; and wherein the first cooling portion comprises a first coolant passage, and the second cooling portion comprises a second coolant passage, wherein coolant flows through the passages.

2. The apparatus of claim 1, wherein the first material comprises stainless steel and the second material comprises aluminum.

3. The apparatus of claim 1, wherein the coolant flows from the second coolant passage to the first coolant passage.

4. The apparatus of claim 1, further comprising a gasket disposed between the first cooling portion and the second cooling portion.

5. The apparatus of claim 4, wherein the gasket comprises mica.

6. The apparatus of claim 4, wherein the gasket comprises a thickness of about 1.5-2.0 mm.

7. The apparatus of claim 1, wherein the first cooling portion comprises a first cooling fin unit, and the second cooling portion comprises a second fin unit.

8. The apparatus of claim 7, wherein the second cooling fin unit comprises aluminum.

9. The apparatus of claim 7, wherein the second cooling fin unit comprises a thickness substantially equal to or greater than 2.5 mm.

10. The apparatus of claim 1, further comprising at least one mounting bracket for mounting the apparatus to a cylinder head.

11. The apparatus of claim 10, further comprising an elastic member disposed between the mounting bracket and the cylinder head.

* * * * *